United States Patent [19]

Waters et al.

[11] Patent Number: 4,832,624

[45] Date of Patent: May 23, 1989

[54] KEY RETENTION SYSTEM

[75] Inventors: Mark H. Waters, Harrisburg; Robert N. Whiteman, Jr., Middletown, both of Pa.

[73] Assignee: AMP Incorporated, Harrisburg, Pa.

[21] Appl. No.: 90,294

[22] Filed: Aug. 31, 1987

[51] Int. Cl.[4] ..... H01R 17/18

[52] U.S. Cl. ..... 439/680; 439/681

[58] Field of Search ..... 439/677, 678, 679, 680, 439/681, 674, 171, 173, 174, 177

[56] References Cited

U.S. PATENT DOCUMENTS

| | | | |
|---|---|---|---|
| 3,177,461 | 4/1965 | Hagan et al. . | |
| 3,325,771 | 6/1967 | Ruehlemann et al. | 439/681 |
| 3,582,867 | 6/1971 | Bainbridge et al. . | |
| 4,032,213 | 6/1977 | Snyder et al. | 439/681 |
| 4,277,126 | 7/1981 | Lincoln . | |
| 4,376,565 | 3/1983 | Bird et al. . | |
| 4,386,820 | 6/1983 | Dola et al. | 439/681 |
| 4,449,767 | 5/1984 | Weidler | 439/681 |
| 4,580,868 | 4/1986 | Verstijnen . | |
| 4,735,583 | 4/1988 | Rudy, Jr. et al. | 439/350 |

FOREIGN PATENT DOCUMENTS

| | | | |
|---|---|---|---|
| 3005364 | 8/1980 | Fed. Rep. of Germany | 439/680 |
| 961714 | 12/1961 | United Kingdom . | |
| 1089073 | 4/1965 | United Kingdom . | |

OTHER PUBLICATIONS

AMP Incorporated Instruction Sheet IS 7404 Released 03/26/84.

"Insertion Error-Proof Board-To-Cable Connector".

EPO Standard Search Report.

EPO STD Search Report Annex.

*Primary Examiner*—David Pirlot

*Attorney, Agent, or Firm*—David L. Smith

[57] ABSTRACT

A key retention system for electrical connectors which includes a connector (12) including a lower backshell (42) having at least one generally T-shaped slot (51) extending therein from a side face (52) thereof for receiving a generally T-shaped key (61). Slot (51) and key (61) are configured to permit key (61) to be easily inserted into slot (51) in the correct orientation and to prevent key (61) from rotating or from moving laterally or longitudinally within slot (51) to any appreciable extent. Locking means comprising a projection (81) extending inwardly from the cover (43) for the lower backshell (42) is positioned to extend into the slot when cover (43) is mounted to lower backshell (42) to lock key (61) in position within slot (51).

16 Claims, 3 Drawing Sheets

KEY RETENTION SYSTEM

BACKGROUND OF THE INVENTION

The present invention relates generally to electrical connectors, and, more particularly, to a key retention system for electrical connectors.

Electrical connectors are frequently provided with keying means to permit particular pairs of connectors to properly mate and to prevent the mating of connectors which are not intended to be mated. Keying means are especially useful when a plurality of identical connectors are positioned in close proximity to one another, for example, on a printed circuit board. The incorrect matching of complementary connectors to the connectors on the board can cause serious damage to the circuits improperly connected thereby; and the keying means, by ensuring that each complementary connector will mate with only the correct one of the plurality of connectors on the board, minimizes the risk of improper connection. Keying means are particularly important when the connections are made by untrained personnel as the risk of improper connection is especially great in such circumstances.

Keying systems are known in which a key member is secured on one of a pair of complementary connectors and is adapted to cooperate with an opposing key member secured in the other of the pair of connectors. Each key member is secured in its connector in a selected orientation with respect to its opposing key member so that when the connectors are intended to be mated, extended keying sections on the key members pass by each other during mating to allow the connectors to properly mate. If one of the key members is secured in an incorrect orientation with respect to its opposing key member, however, the extended keying sections on the key members will abut one another during mating to prevent proper mating of the connectors.

One known type of key member is provided with a portion having a polygonal cross-section and is adapted to be secured within a passageway in a connector in a selected orientation. The number of sides of the polygonal shape determines the number of possible orientations of the key member.

To ensure that the keying system operates reliably, it is important that the key members be accurately positioned and retained within their respective connectors with the keying sections thereof in the selected orientation. Any significant movement of a key member within its connector can prevent the proper mating of connectors which are intended to be mated, or permit the mating of connectors which are not intended to be mated. Many known keying systems, however, are not satisfactory in preventing movement of the key members.

Also, orienting of a key member and positioning and securing the key member in a connector is typically performed by hand, and, in many known keying systems is a difficult, time-consuming procedure. Orienting and securing of the key member is particularly troublesome in small connectors inasmuch as the key member also tends to be quite small and rather difficult to handle.

SUMMARY OF THE INVENTION

The present invention relates to a key retention system for electrical connectors that permits a key member to be quickly positioned and secured in a connector in a desired orientation, and which reliably retains the key member in the selected orientation. The key retention system of the invention comprises: a connector including structure for defining a generally T-shaped slot, the slot including an enlarged first slot portion and a second slot portion of reduced size extending from the enlarged slot portion to an end face of the structure; and a generally T-shaped key, the key including a body section adapted to be received within the slot and a keying section adapted to extend out of the slot beyond the end face of the structure, the body section of the key including an enlarged first body portion of polygonal cross-section adapted to be received in the first slot portion, and a second body portion of reduced size adapted to be received in the second slot portion. The slot is sized to receive the body section of the key with a rather close fit to prevent any significant movement of the key longitudinally or laterally within the slot, and the enlarged first slot portion includes opposed side walls which are adapted to cooperate with opposite sides of the polygonal body portion of the key to prevent rotation of the key within the slot and to retain the keying section in a selected orientation.

In accordance with the invention, the slot extends into the structure from a side face of the structure, and the key is adapted to be inserted into the slot from the side face. After the key is positioned in the slot, locking means locks the key within the slot and prevents the key from moving up or down in the slot. Thus the keying system of the invention ensures that the key is reliably retained in the proper position within the slot at all times.

In accordance with a presently preferred embodiment, the structure for defining the generally T-shaped slot comprises the lower backshell of the connector and includes a pair of identical T-shaped slots adjacent opposite sides thereof. The locking means comprises a pair of projections extending inwardly from the inside surface of a cover for the lower backshell. When the cover is mounted to the lower backshell, the projections thereon extend into the slots and cooperate with the second body portions of the keys positioned therein to lock the keys within the slots.

According to a further aspect of the invention, the slots include upper sidewall portions which are tapered inwardly to assist in inserting the keys into the slots. In addition, both the slots and the body portions of the keys include curved surface portions positioned to urge the keys rearwardly within the slots as they are inserted into the slots to assist in their positioning.

Further advantages and specific details of the invention will become apparent hereinafter in conjunction with the following detailed description of a presently preferred embodiment.

DETAILED DESCRIPTION OF THE PREFERRED EMBODIMENT

Figure 1:
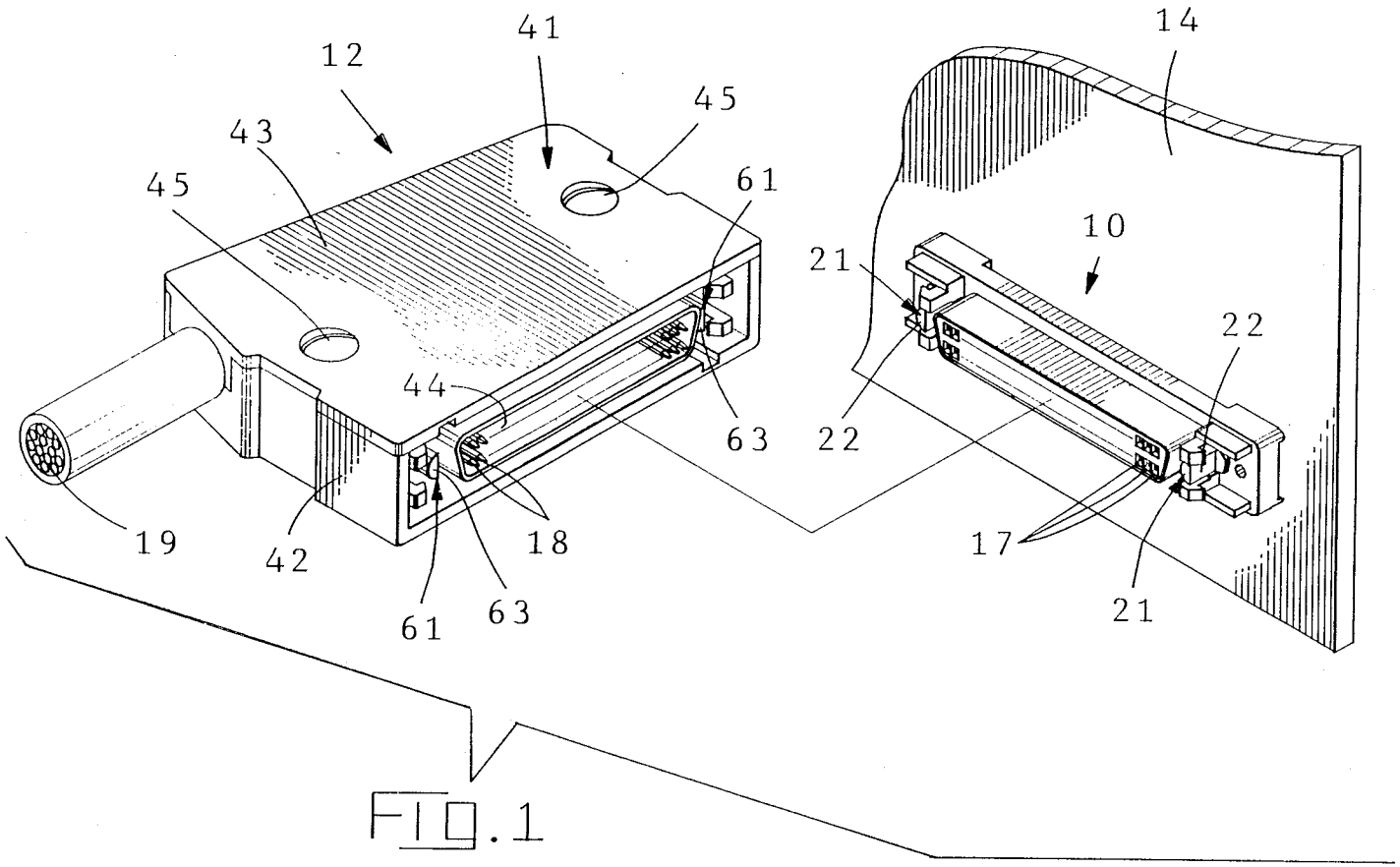
FIG. 1 is a perspective view of a cable-terminating electrical connector incorporating the key retention system of the present invention, and a board-mounted electrical connector complementary therewith.

FIG. 1 illustrates a pair of complementary electrical connectors 10 and 12 of the high density type containing two rows of electrical contacts which are adapted to be mated to complete a plurality of electrical circuits through the connectors.

Connector 10 is designed to be mounted to a printed circuit board or other panel designated by reference numeral 14, and comprises a vertically oriented receptacle connector having a plurality of female contacts 17.

Connector 12 is a cable-terminating connector and comprises a right angle plug connector having a plurality of male contacts 18 which are adapted to be electrically connected to external circuitry via cables 19. The embodiment illustrated and described herein is intended to be exemplary only. Either connector can comprise vertically oriented or right angle connectors, and either can be of the plug or receptacle type as required for a particular application.

Connectors 10 and 12 are particularly designed for use in applications in which a plurality of identical connectors are mounted in close proximity to one another. For example, printed circuit bard 14 can comprise a panel on a computer or the like and contain a plurality of connectors 10 to permit various external equipment to be connected to the computer via a plurality of complementary connectors 12 coupled to the external equipment. In such applications, it is important to ensure that each connector be mated with a correct complementary connector as mismatching connector pairs can result in damage to the electrical circuits improperly connected thereby.

To ensure that each connector 10 can mate with only the correct complementary connector 12, the connectors include a keying system to prevent incorrect connector pairs from being mated. More particularly, connector 10 includes a pair of keys 21 which include keying sections 22 which can be positioned at any selected one of a plurality of orientations. Connector 12 similarly includes a pair of keys 61 having keying sections 63 which are also positioned in a selected orientation. As is known to those skilled in the art, if the keys of connectors 10 and 12 are properly oriented with respect to one another, the keying sections thereof pass by each other as the connectors are mated permitting the connectors to properly mate. If, however, the keys are not properly oriented with respect to one another, their keying sections will impinge against one another during mating to prevent the connectors from being mated. The keying system thus permits connectors to mate with only the proper complementary connector and not with an incorrect complementary connector.

For the keying system to operate properly during mating of the connectors 10 and 12, it is important that the keys 21 and 61 of the connectors be properly positioned and oriented with respect to one another. If any of the keys move or shift to any appreciable extent within their respective connector, the keying system may operate improperly and prevent the proper mating of connectors which are intended to be mated or permit the mating of connectors which are not intended to be mated. The present invention provides a key retention system for cable-terminating connector 12 which is effective in permitting keys 61 to be quickly positioned within connector 12 in the correct orientation and which reliably retains the oriented keys firmly in the selected orientation.

With reference to FIG. 1, cable-terminating connector 12 includes a housing 41 comprised of a lower backshell 42 and a cover 43 secured thereto by screws 45. A plastic insert 44 is supported within housing 41 and includes a plurality of passageways for supporting the plurality of male contacts 18. Cables 19, connected to the male contacts 18, extend out of the connector through an opening in the lower backshell.

Figure 2:
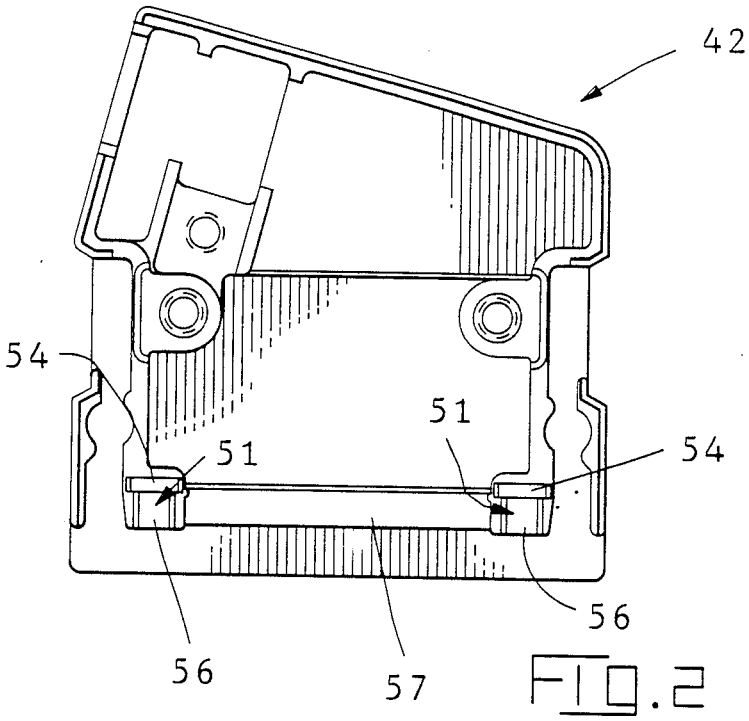
FIG. 2 is a top view of the lower backshell of the cable-terminating connector of FIG. 1.
Figure 3:
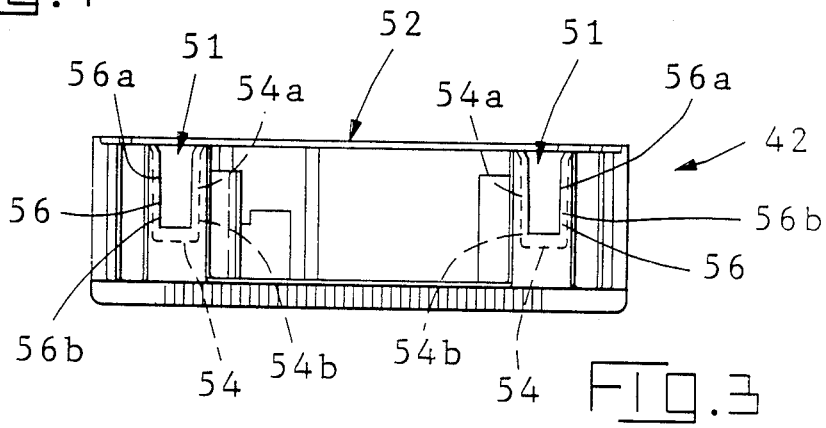
FIG. 3 is a front end view of the lower backshell of FIG. 2.

FIGS. 2–5 illustrate cable-terminating connector 12 in greater detail. As shown in FIGS. 2 and 3, lower backshell 42 includes a pair of identical slots 51 extending thereinto from substantially opposite sides of the top side face 52 thereof. As shown in FIG. 2, slots 51 have a generally T-shaped configuration when viewed from the top side and include an enlarged first slot portion 54 and a second slot portion 56 of reduced size. Slot portion 54 is both wider and deeper than slot portion 56 as shown in FIG. 3, and slot portion 56 extends from slot portion 54 to the front end face 57 of lower backshell 42.

When viewed from the front end 57 as shown in FIG. 3, the slot portions 54 and 56 are of generally rectangular shape. The side walls of the slot portions 54 and 56, however, include first upper side wall portions **54*a* and 56*a*, respectively, which are tapered inwardly from top surface 52; and second lower side wall portions 54*b* and 56*b***, respectively, which are substantially parallel.

Figure 5:
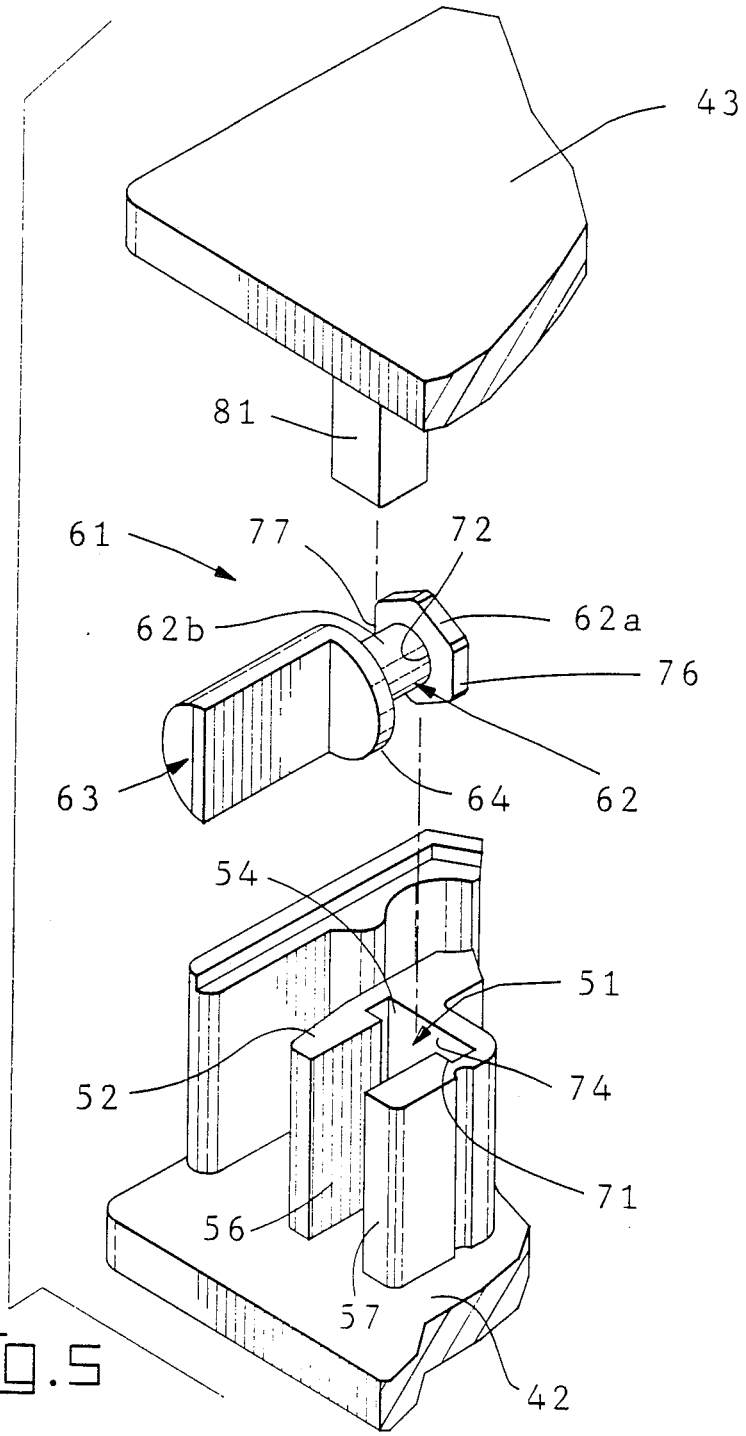
FIG. 5 is an exploded perspective view of a portion of the cable-terminating connector of FIG. 1.

Each slot 51 is adapted to receive a key 61 as illustrated in FIG. 5. Key 61 includes a body section 62 and a keying section 63. Body section 62 is adapted to extend into and be received within a slot 51 and includes an enlarged first body portion **62*a* and a second body portion 62*b* of reduced size. Keying section 63 is of generally semi-circular cross-section and is adapted to extend outwardly of slot 51 beyond front end face 57 to cooperate with a keying section 22 of a key 21 on complementary connector 10**.

Enlarged first body portion **62*a* of key 61 has a polygonal cross-section, preferably a hexagonal cross-section, and is adapted to received in enlarged first slot portion 54. As is known to those skilled in the art, the polygonal shape of body portion 62*a* defines the different possible orientations of keying section 63, and is inserted into the slot in the selected orientation. Body portion 62*b* of key 61 is of circular cross-section and is adapted to be received in slot portion 56. Key 61 also includes an annular flange 64 which is positioned against front end face 57 of lower backshell 42 when key 61 is positioned within slot 51**.

Slot 51 and the body section of key 61 are sized so that key 61 fits within slot 51 with a rather close fit such that when the key is positioned within the slot, it will be unable to move longitudinally or laterally to any significant extent. The tapered upper wall portions **54*a* and 56*a* of the slot, however, assist in inserting the key into the slot. In addition, the corner 71 of the enlarged first slot portion and the annular corner 72 of the key between key body portions 62*a* and 62*b* are somewhat rounded to urge the key rearwardly into the slot against back surface 74** as the key is inserted into the slot to assist in positioning the key.

The key is inserted into the slot after rotating the key to orient keying section 63 to a desired orientation. After the key is inserted into the slot in the selected orientation, the opposed side faces of the polygonal enlarged first body portion 62*a* of key 61, i.e., surfaces 76 and 77, are parallel to the parallel, lower side wall portions 54*b* of the enlarged first slot portion and fit very closely therebetween such that the key is thereafter prevented from rotating to any appreciable extent within the slot.

Thus, when key 61 is inserted into slot 51, the key will be accurately positioned within the slot and is prevented from rotating and moving either laterally or longitudinally within the slot.

Figure 4:
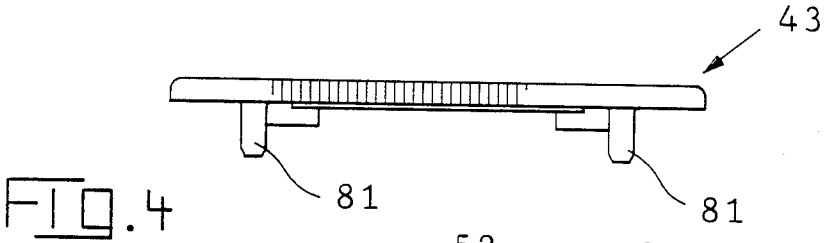
FIG. 4 is a front end view of the cover of the cable-terminating connector of FIG. 1.

The key is locked in position in the slot and prevented from moving up or down within the slot when cover 43 is mounted to the lower backshell 42. More particularly, as shown in FIG. 4, cover 43 is includes a pair of projections 81 which extend downwardly from the inside surface thereof. When cover 43 is mounted to backshell 42, the projections 81 extend into slots 51 and press against second body portions 62*b* of the keys 61 and lock the keys in the slots and prevent the keys from moving up or down in the slots. By extending between annular flange 64 and enlarged first body portion 62*a* of the keys, projections 81 also assist in preventing longitudinal movement of the keys in the slots. The slots are preferably designed such that when the keys are locked in the slots, the keys are located on the centerline of the connector.

Although what has been described herein constitutes a presently preferred embodiment of the invention, it should be recognized that the invention could take numerous other forms. Accordingly, it should be understood that the invention is to be limited only insofar as is required by the scope of the following claims.

We claim:

1. A key retention system for electrical connectors comprising a connector including structure having a slot extending thereinto from a side face thereof, said slot having a generally T-shaped configuration when viewed from said side face and including an enlarged first slot portion and a second slot portion of reduced size which extends from the enlarged slot portion to an end face of the structure which is adjacent to said side face;

a generally T-shaped key, said key including a body section adapted to be received within said slot and a keying section adapted to extend out of said slot beyond said end face of said structure, said body section of said key including an enlarged first body portion of polygonal cross-section adapted to be received in the first slot portion, and a second body portion of reduced size adapted to be received in the second slot portion, said slot being sized to receive said body section of said key with a rather close fit to prevent any significant movement of said key longitudinally or laterally within said slot, and said enlarged first slot portion including opposed side walls which are adapted to cooperate with opposite sides of said polygonal body portion of said key to prevent rotation of said key within said slot, and to retain said keying section in a selected orientation; and locking means comprising a projection adapted to extend into said slot from said side face of said structure for locking said key in position in said slot and for preventing said key from moving up or down within said slot.

2. A key retention system for electrical connectors comprising a connector including first structure for defining a generally T-shaped slot extending into said first structure from a side face thereof, said slot including an enlarged first slot portion, and a second slot portion of reduced size extending from the enlarged slot portion to an end face of the first structure; and a generally T-shaped key, said key including a body section adapted to be received within said slot and a keying section adapted to extend out of said slot beyond said end face of said first structure, said body section of said key including an enlarged first body portion of polygonal cross-section adapted to be received in the first slot portion and a second body portion of reduced size adapted to be received in the second slot portion, said slot being sized to receive said body section of said key with a rather close fit to prevent any significant movement of said key longitudinally or laterally within said slot, said enlarged first slot portion including opposed side walls which are adapted to cooperate with opposite sides of said polygonal body portion of said key to prevent rotation of said key within said slot and to retain said keying section in a selected orientation, said first and second slot portions further including upper side wall portions which are tapered inwardly from said side face to assist in inserting said key into said slot.

3. The key retention system of claim 2 wherein said first and second slot portions include lower side wall portions which are substantially parallel to one another, said lower side wall portions of said first slot portion cooperating with opposite sides of said polygonal body portion of said key to prevent rotation of said key within said slot and to retain said key in said selected orientation.

4. A key retention system for a cable-terminating electrical connector comprising:

a lower backshell, said lower backshell including means for defining a pair of spaced, generally T-shaped slots extending thereinto from a side face thereof, each of said slots including an enlarged first slot portion and a second slot portion of reduced size, said second slot portion extending from said first slot portion to a front end face of said lower backshell;

a generally T-shaped key adapted to be received in each of said slots, each of said keys including a first body section adapted to be received within said slot and a keying section adapted to extend out of said slot beyond said front end face of said lower backshell, said body section of said key comprising an enlarged first body portion of polygonal cross-section adapted to be received within said first slot portion, and a second body portion of generally circular cross-section adapted to be received in said second slot portion, said first slot portion including a pair of substantially parallel opposed sidewall portions which are spaced to provide a relatively close fit with opposite sides of said polygonal first body portion of said key to prevent rotation of said key within said slot and to retain said keying section of said key in a selected orientation; and a cover for said lower backshell, said cover including locking means for locking said keys within their respective slots when said cover is mounted to said lower backshell.

5. The key retention system of claim 4 wherein said locking means comprises a pair of projections extending inwardly from the inside surface of said cover when said cover is mounted to said lower backshell, said projections being positioned to extend into said slots for locking said keys within said slots and for preventing said keys from moving up or down within said slots.

6. The key retention system of claim 4 wherein said first and second slot portions include upper sidewall portions which are tapered inwardly from said side face to assist in inserting said keys into said slots.

7. A key retention system for electrical connectors comprising a connector having a first structure having a slot extending thereinto from an end face thereof said slot being adapted to receive a key therein which includes a keying section adapted to extend out of said slot beyond said end face of said first structure; and a second structure of said connector adapted to be connected to said first structure, said second structure comprising a cover for said first structure and including a projection thereon positioned to extend into said slot from a side face of said first structure which is adjacent to said end face when said first structure of said connector and said cover are connected to lock said key in said slot.

8. The key retention system of claim 16 and further including means for releasably connecting said cover to said lower backshell for releasably locking said key in said slot.

9. The key retention system of claim 8 wherein said lower backshell includes a pair of spaced slots extending thereinto from said end face for receiving a pair of keys, and wherein said cover includes a pair of spaced projections extending inwardly from the inside surface of said cover when said cover is mounted to said lower backshell and positioned to extend into said pair of slots from said side face of said lower backshell for locking each of said pair of keys in said slots.

10. A key retention system for electrical connectors comprising a connector including first structure having a slot extending thereinto from a side face thereof, said slot having a generally T-shaped configuration when viewed from said side face and including an enlarged first slot portion and a second slot portion of reduced size which extends from the enlarged slot portion to an end face of the first structure which is adjacent to said side face;

a generally T-shaped key, said key including a body section adapted to be received within said slot and a keying section adapted to extend out of said slot beyond said end face of said first structure, said body section of said key including an enlarged first body portion of polygonal cross-section adapted to be received in the first slot portion, and a second body portion of reduced size adapted to be received in the second slot portion, said slot being sized to receive said body section of said key with a rather close fit to prevent any significant movement of said key longitudinally or laterally within said slot, and said enlarged first slot portion including opposed side walls which are adapted to cooperate with opposite sides of said polygonal body portion of said key to prevent rotation of said key within said slot, and to retain said keying section in a selected orientation; and a projection on a second structure of said connector adapted to extend into said slot from said side face of said first structure for locking said key in said slot.

11. The key retention system of claim 10 wherein said key and said slot include curved surface portions for urging said key rearwardly in said slot for assisting in positioning said key in said slot.

12. The key retention system of claim 10 wherein said first structure comprises a lower backshell of said connector and said second structure comprises a cover for said lower backshell, said projection extending from the inside surface of said cover and aligned with said slot for extending into said slot from said side face of said lower backshell when said cover is mounted on said lower backshell.

13. The key retention system of claim 10 wherein said projection is positioned to extend into said second slot portion for cooperating with said second body portion of said key for locking said key in said slot.

14. The key retention system of claim 10 wherein said first structure has a pair of spaced slots extending thereinto from said side face thereof, each of said pair of slots having a generally T-shaped configuration when viewed from said side face for receiving generally T-shaped keys therein and for positioning and retaining said keys on the centerline of said connector, and wherein said second structure includes a pair of projections adapted to extend into said pair of slots from said side face of said structure for locking said keys in position in said slots and for preventing said keys from moving up or down within said slots.

15. The key retention system of claim 10 wherein said connector comprises a cable-terminating connector.

16. A key retention system for electrical connectors comprising a connector having a lower backshell having a slot extending thereinto from an end face thereof, said slot being adapted to receive a key therein which includes a keying section adapted to extend out of said slot beyond said end face of said lower backshell; and a cover for said lower backshell adapted to be connected to said lower backshell, said cover including a projection thereon positioned to extend into said slot from a side face of said lower backshell which is adjacent to said end face when said cover and said lower backshell are connected to lock said key in said slot.

* * * * *